US012091148B2

(12) United States Patent
Ikegaya

(10) Patent No.: US 12,091,148 B2
(45) Date of Patent: Sep. 17, 2024

(54) SYSTEM FOR AND METHOD OF CONTROLLING WATERCRAFT

(71) Applicant: YAMAHA HATSUDOKI KABUSHIKI KAISHA, Iwata (JP)

(72) Inventor: Yuji Ikegaya, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 336 days.

(21) Appl. No.: 17/547,281

(22) Filed: Dec. 10, 2021

(65) Prior Publication Data

US 2022/0194544 A1 Jun. 23, 2022

(30) Foreign Application Priority Data

Dec. 23, 2020 (JP) ..... 2020-213784

(51) Int. Cl.
*B63H 25/42* (2006.01)
*B63H 20/00* (2006.01)
*B63H 20/12* (2006.01)

(52) U.S. Cl.
CPC ..... *B63H 25/42* (2013.01); *B63H 20/12* (2013.01); *B63H 2020/003* (2013.01)

(58) Field of Classification Search
CPC ... B63H 25/42; B63H 20/12; B63H 2020/003
See application file for complete search history.

(56) References Cited

U.S. PATENT DOCUMENTS

2015/0089427 A1* 3/2015 Akuzawa ..... G05D 1/0206 715/771
2015/0261222 A1* 9/2015 Morikami ..... B63H 25/38 701/21
2015/0307176 A1* 10/2015 Nakayasu ..... B63H 20/12 701/21

FOREIGN PATENT DOCUMENTS

JP 2015-66979 A 4/2015
JP 2015123806 A * 7/2015
WO WO-2006053974 A1 * 5/2006 ..... B63H 25/04
WO WO-2016037210 A1 * 3/2016 ..... G06Q 10/04

OTHER PUBLICATIONS

Machine translation of description of WO-2006053974-A1 (Year: 2006).*
Machine translation of description of WO-2016037210-A1 (Year: 2016).*
Machine translation of description of JP-2015123806-A (Year: 2015).*

* cited by examiner

*Primary Examiner* — Anne Marie Antonucci
*Assistant Examiner* — Jared C Bean
(74) *Attorney, Agent, or Firm* — Keating & Bennett, LLP

(57) ABSTRACT

In a system for controlling a watercraft, when a first mode is selected, a controller determines a route on which a single or a plurality of specified spots including a destination are located, and controls a marine propulsion device such that the watercraft moves along the route with a bow thereof being kept oriented in a predetermined cardinal direction. When a second mode is selected, the controller controls the marine propulsion device such that the bow of the watercraft is kept oriented in the predetermined cardinal direction without determining the route. The controller obtains a position of the watercraft. In the first mode, the controller determines whether or not the watercraft has passed through the destination. When the watercraft has passed through the destination in the first mode, the controller performs a mode switching from the first mode to the second mode and controls the marine propulsion device in the second mode.

8 Claims, 8 Drawing Sheets

SYSTEM FOR AND METHOD OF CONTROLLING WATERCRAFT

CROSS REFERENCE TO RELATED APPLICATIONS

This application claims the benefit of priority to Japanese Patent Application No. 2020-213784 filed on Dec. 23, 2020. The entire contents of this application are hereby incorporated herein by reference.

BACKGROUND OF THE INVENTION

1. Field of the Invention

The present invention relates to a system for and a method of controlling a watercraft.

2. Description of the Related Art

There has been conventionally known a type of system for automatically controlling a watercraft to move toward a specified target spot. For example, a system described in Japan Laid-open Patent Application Publication No. 2015-66979 controls an outboard motor for a watercraft such that the watercraft moves toward a specified target spot under an autopilot mode. When the watercraft approaches the target spot, the system moors the watercraft in the target spot.

Chances are that, when fishing, a user of the watercraft wants to continue fishing by moving the watercraft along the stream of water after arrival at the target spot. However, when the watercraft is moored in the target spot by the system as described above, the user is required to manually operate the watercraft to move the watercraft again. Thus, there is room for improvement in the system.

SUMMARY OF THE INVENTION

Preferred embodiments of the present invention provide systems for and methods of controlling a watercraft such that a user is able to comfortably continue fishing even after the watercraft automatically moves to a target spot.

A system for controlling a watercraft according to a preferred embodiment of the present invention includes a marine propulsion device, a position sensor, an input, and a controller. The position sensor detects a position of the watercraft. The input is manually operable. The input outputs an operating signal indicating a selected one of a plurality of modes. The plurality of modes include a first mode and a second mode. The controller receives the operating signal. When the selected one of the plurality of modes is the first mode, the controller determines a route on which a single or a plurality of specified spots including a destination are located, and controls the marine propulsion device such that the watercraft moves along the route with a bow thereof being kept oriented in a predetermined cardinal direction. When the selected one of the plurality of modes is the second mode, the controller controls the marine propulsion device such that the bow of the watercraft is kept oriented in the predetermined cardinal direction without determining the route. The controller obtains the position of the watercraft. The controller determines whether or not the watercraft has passed through the destination in the first mode. When the watercraft has passed through the destination in the first mode, the controller performs mode switching from the first mode to the second mode and controls the marine propulsion device in the second mode.

A method of controlling a watercraft including a marine propulsion device according to another preferred embodiment of the present invention includes receiving an operating signal indicating a selected one of a plurality of modes including a first mode and a second mode; when the selected one of the plurality of modes is the first mode, determining a route on which a single or a plurality of specified spots including a destination are located and controlling the marine propulsion device such that the watercraft moves along the route with a bow thereof being kept oriented in a predetermined cardinal direction; when the selected one of the plurality of modes is the second mode, controlling the marine propulsion device such that the bow of the watercraft is kept oriented in the predetermined cardinal direction without determining the route; obtaining a position of the watercraft; determining whether or not the watercraft has passed through the destination in the first mode; and when the watercraft has passed through the destination in the first mode, performing mode switching from the first mode to the second mode and controlling the marine propulsion device in the second mode.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
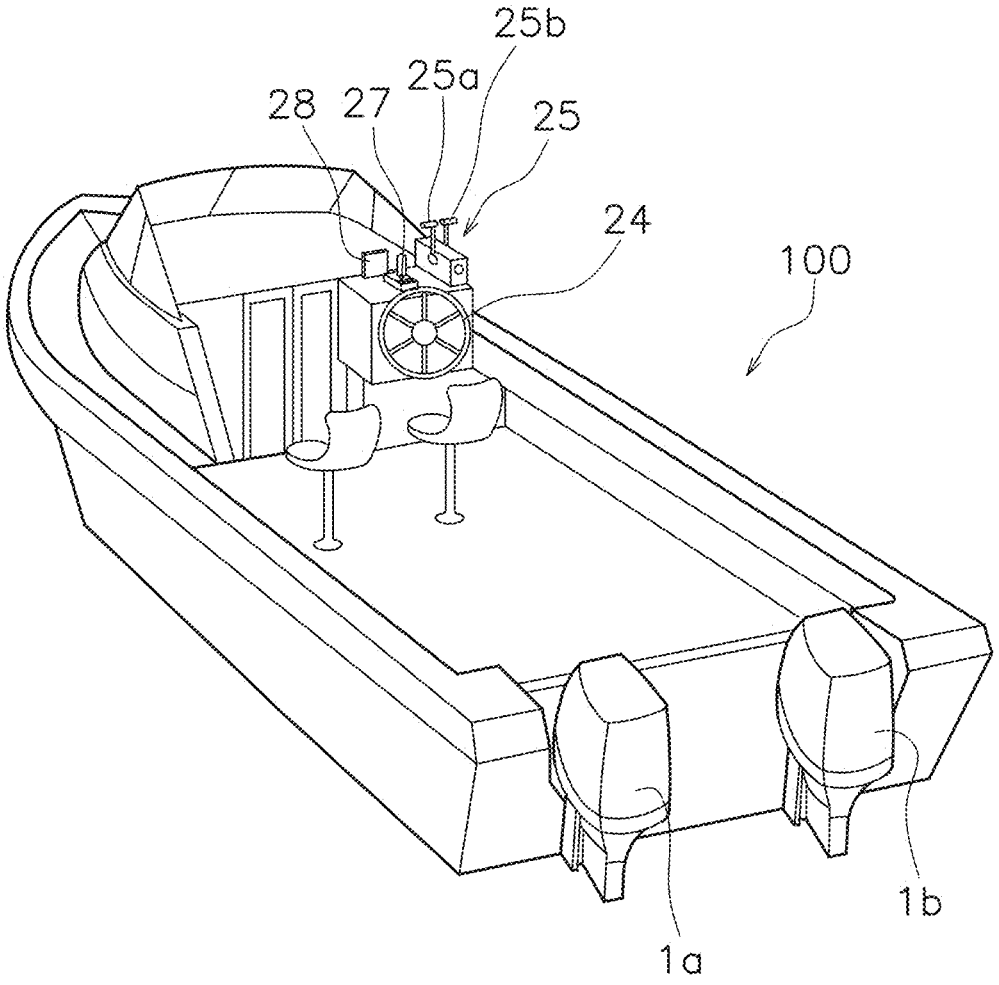
FIG. 1 is a perspective view of a watercraft to which marine propulsion devices according to preferred embodiments of the present invention are mounted.

Preferred embodiments of the present invention will be hereinafter explained with reference to drawings. FIG. 1 is a perspective view of a watercraft 100 to which marine propulsion devices 1*a* and 1*b* according to one of the preferred embodiments of the present invention are mounted. The marine propulsion devices 1*a* and 1*b* are mounted to the watercraft 100 as a plurality of marine propulsion devices. In the present preferred embodiment, the marine propulsion devices 1*a* and 1*b* are outboard motors. The marine propulsion devices 1*a* and 1*b* are attached to the stern of the watercraft 100. The marine propulsion devices 1*a* and 1*b* are aligned in a width direction of the watercraft 100. Specifically, the marine propulsion device 1*a* is disposed on the port side of the watercraft 100. The marine propulsion device 1*b* is disposed on the starboard side of the watercraft 100. Each marine propulsion device 1*a*, 1*b* generates a thrust to propel the watercraft 100.

Figure 2:
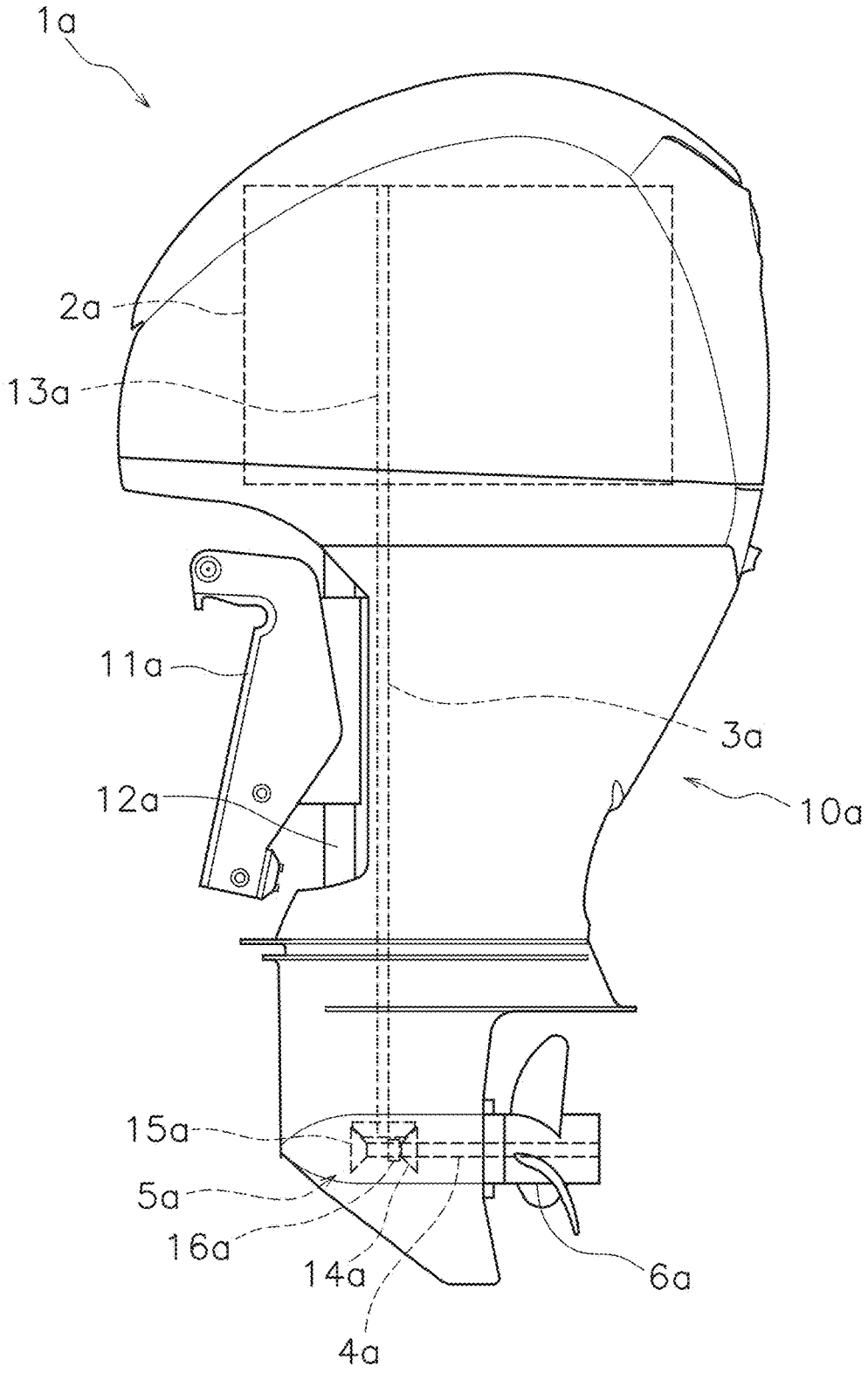
FIG. 2 is a side view of one of the marine propulsion devices.

FIG. 2 is a side view of the marine propulsion device 1*a*. The structure of the marine propulsion device 1*a* will be hereinafter explained. However, the structure of the marine propulsion device 1*a* is also true of the marine propulsion device 1*b*. The marine propulsion device 1*a* is attached to the watercraft 100 through a bracket 11*a*. The bracket 11*a* supports the marine propulsion device 1*a* such that the marine propulsion device 1*a* is rotatable about a steering shaft 12*a*. The steering shaft 12*a* extends in an up-and-down direction of the marine propulsion device 1*a*.

The marine propulsion device 1*a* includes a drive unit 2*a*, a drive shaft 3*a*, a propeller shaft 4*a*, a shift mechanism 5*a*, and a housing 10*a*. The drive unit 2*a* generates the thrust to propel the watercraft 100. The drive unit 2*a* is an internal combustion engine, for example. The drive unit 2*a* includes a crankshaft 13*a*. The crankshaft 13*a* extends in the up-and-down direction of the marine propulsion device 1*a*. The drive shaft 3*a* is connected to the crankshaft 13*a*. The drive shaft 3*a* extends in the up-and-down direction of the marine propulsion device 1*a*. The propeller shaft 4*a* extends in a back-and-forth direction of the marine propulsion device 1*a*. The propeller shaft 4*a* is connected to the drive shaft 3*a* through the shift mechanism 5*a*. A propeller 6*a* is attached to the propeller shaft 4*a*.

The shift mechanism 5*a* includes a forward moving gear 14*a*, a rearward moving gear 15*a*, and a dog clutch 16*a*. When gear engagement of each gear 14*a*, 15*a* is switched by the dog clutch 16, the direction of rotation transmitted from the drive shaft 3*a* to the propeller shaft 4*a* is switched. Movement of the watercraft 100 is thus switched between forward movement and rearward movement. The housing 10*a* accommodates the drive unit 2*a*, the drive shaft 3*a*, the propeller shaft 4*a*, and the shift mechanism 5*a*.

Figure 3:
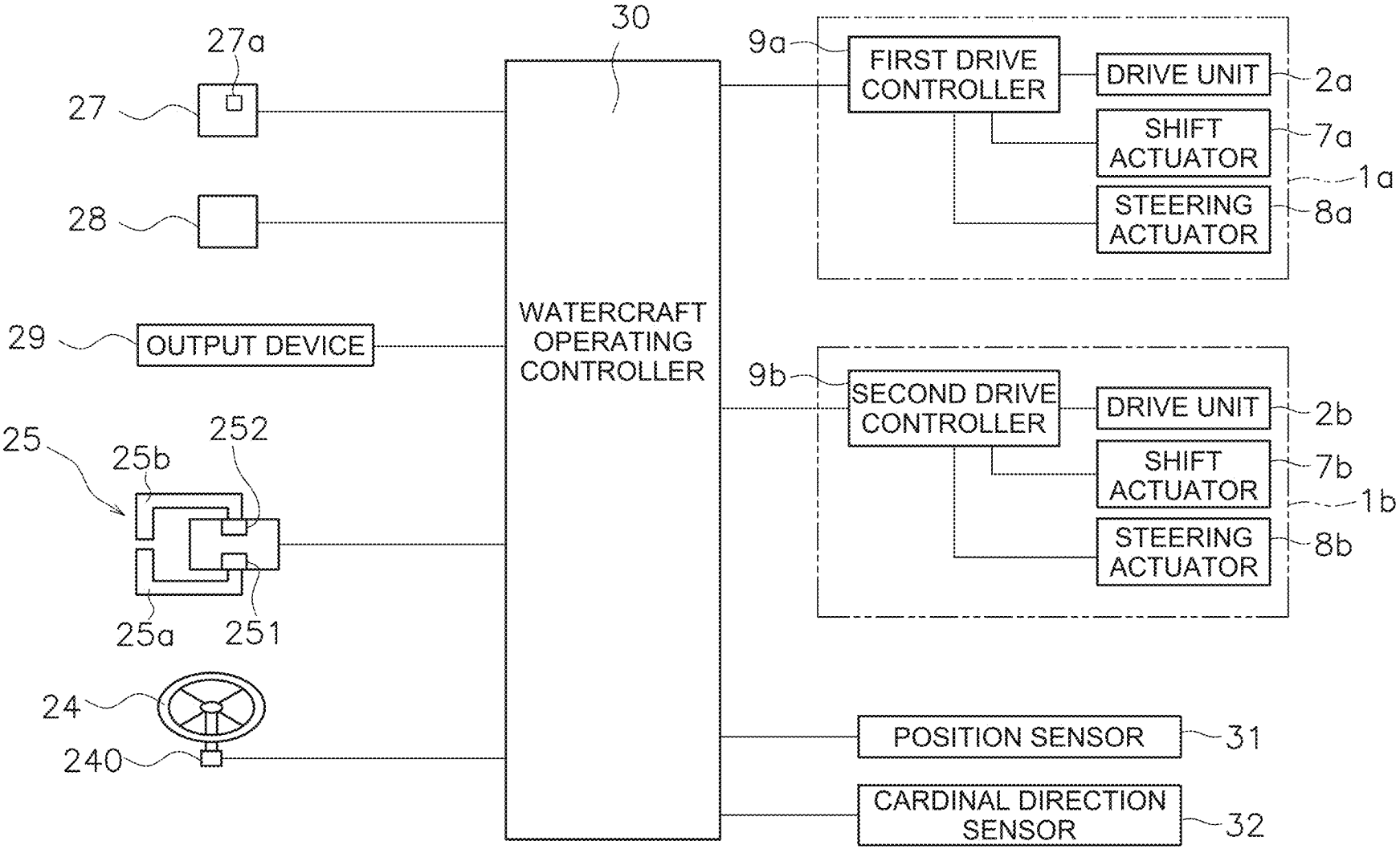
FIG. 3 is a schematic diagram showing a configuration of a watercraft operating system for the watercraft.

FIG. 3 is a schematic diagram showing a configuration of a watercraft operating system for the watercraft 100. As shown in FIG. 3, the marine propulsion device 1*a* includes a shift actuator 7*a* and a steering actuator 8*a*.

The shift actuator 7*a* is connected to the dog clutch 16*a* of the shift mechanism 5*a*. The shift actuator 7*a* actuates the dog clutch 16*a* to switch gear engagement of each gear 14*a*, 15*a*. Movement of the watercraft 100 is thus switched between forward movement and rearward movement. The shift actuator 7*a* is, for instance, an electric motor. However, the shift actuator 7*a* may be another type of actuator such as an electric cylinder, a hydraulic motor, or a hydraulic cylinder.

The steering actuator 8*a* is connected to the marine propulsion device 1*a*. The steering actuator 8*a* rotates the marine propulsion device 1*a* about the steering shaft 12*a*. Accordingly, the marine propulsion device 1*a* changes the rudder angle. The rudder angle refers to an angle of the propeller shaft 4*a* with respect to the back-and-forth direction of the marine propulsion device 1*a*. The steering actuator 8*a* is, for instance, an electric motor. However, the steering actuator 8*a* may be another type of actuator such as an electric cylinder, a hydraulic motor, or a hydraulic cylinder.

The marine propulsion device 1*a* includes a first drive controller 9*a*. The first drive controller 9*a* includes a processor such as a CPU (Central Processing Unit) and memories such as a RAM (Random Access Memory) and a ROM (Read Only Memory). The first drive controller 9*a* stores a program and data to control the marine propulsion device 1*a*. The first drive controller 9*a* controls the drive unit 2*a*.

The marine propulsion device 1*b* includes a drive unit 2*b*, a shift actuator 7*b*, a steering actuator 8*b*, and a second drive controller 9*b*. The drive unit 2*b*, the shift actuator 7*b*, the steering actuator 8*b*, and the second drive controller 9*b* in the marine propulsion device 1*b* are configured in similar manner to the drive unit 2*a*, the shift actuator 7*a*, the steering actuator 8*a*, and the first drive controller 9*a* in the marine propulsion device 1*a*, respectively.

The watercraft operating system includes a steering wheel 24, a remote controller 25, a first input device 27, a second input device 28, and an output device 29. The steering wheel 24, the remote controller 25, the first input device 27, the second input device 28, and the output device 29 are disposed in a cockpit of the watercraft 100. The steering wheel 24, the remote controller 25, the first input device 27, and the second input device 28 are manually operable.

The steering wheel 24 allows an operator to operate a turning direction of the watercraft 100. The steering wheel 24 includes a sensor 240. The sensor 240 outputs a steering signal indicating an operating direction and an operating amount of the steering wheel 24.

The remote controller 25 includes a first throttle lever 25*a* and a second throttle lever 25*b*. The first throttle lever 25*a* allows the operator to regulate the magnitude of the thrust generated by the marine propulsion device 1*a*. The first throttle lever 25*a* also allows the operator to switch the direction of the thrust generated by the marine propulsion device 1*a* between a forward moving direction and a rearward moving direction. The first throttle lever 25*a* is operable from a neutral position to a forward moving directional side and a rearward moving directional side. The neutral position is a position located between the forward moving directional side and the rearward moving directional side. The first throttle lever 25*a* includes a sensor 251. The sensor 251 outputs a throttle signal indicating an operating direction and an operating amount of the first throttle lever 25*a*.

The second throttle lever 25*b* allows the operator to regulate the magnitude of the thrust generated by the marine propulsion device 1*b*. The second throttle lever 25*b* also allows the operator to switch the direction of the thrust generated by the marine propulsion device 1*b* between the forward moving direction and the rearward moving direction. The second throttle lever 25*b* is configured in similar manner to the first throttle lever 25*a*. The second throttle lever 25*b* includes a sensor 252. The sensor 252 outputs a throttle signal indicating an operating direction and an operating amount of the second throttle lever 25*b*.

The watercraft operating system includes a watercraft operating controller 30. The watercraft operating controller 30 includes a processor such as a CPU and memories such as a RAM and a ROM. The watercraft operating controller 30 stores programs and data to control the marine propulsion devices 1*a* and 1*b*. The watercraft operating controller 30 is connected to the first and second drive controllers 9*a* and 9*b* through wired or wireless communication. The watercraft operating controller 30 is connected to the steering wheel 24, the remote controller 25, the first input device 27, the second input device 28, and the output device 29 through wired or wireless communication.

The watercraft operating controller 30 receives the steering signal from the sensor 240. The watercraft operating controller 30 receives the throttle signals from the sensors 251 and 252. The watercraft operating controller 30 outputs command signals to the first and second drive controllers 9*a* and 9*b* based on the signals received from the sensors 240, 251, and 252. The command signal is transmitted to the shift actuator 7*a* and the steering actuator 8*a* through the first drive controller 9*a*. The command signal is transmitted to the shift actuator 7*b* and the steering actuator 8*b* through the second drive controller 9*b*.

For example, the watercraft operating controller 30 outputs a command signal for the shift actuator 7*a* in accordance with the operating direction of the first throttle lever 25*a*. In response, shifting between forward movement and rearward movement by the marine propulsion device 1*a* is performed. The watercraft operating controller 30 outputs a throttle command for the drive unit 2*a* in accordance with the operating amount of the first throttle lever 25*a*. The first drive controller 9*a* controls an output rotational speed of the marine propulsion device 1*a* in accordance with the throttle command.

The watercraft operating controller 30 outputs a command signal for the shift actuator 7*b* in accordance with the operating direction of the second throttle lever 25*b*. In response, shifting between forward movement and rearward movement by the marine propulsion device 1*b* is performed. The watercraft operating controller 30 outputs a throttle command for the drive unit 2*b* in accordance with the operating amount of the second throttle lever 25*b*. The second drive controller 9*b* controls an output rotational speed of the marine propulsion device 1*b* in accordance with the throttle command.

The watercraft operating controller 30 outputs command signals for the steering actuators 8*a* and 8*b* in accordance with the operating direction and the operating amount of the steering wheel 24. When the steering wheel 24 is operated leftward from the neutral position, the watercraft operating controller 30 controls the steering actuators 8*a* and 8*b* such that the marine propulsion devices 1*a* and 1*b* are rotated rightward. The watercraft 100 thus turns leftward.

When the steering wheel 24 is operated rightward from the neutral position, the watercraft operating controller 30 controls the steering actuators 8*a* and 8*b* such that the marine propulsion devices 1*a* and 1*b* are rotated leftward. The watercraft 100 thus turns rightward. Additionally, the watercraft operating controller 30 controls the rudder angles of the marine propulsion devices 1*a* and 1*b* depending on the operating amount of the steering wheel 24.

The watercraft operating system includes a position sensor 31. The position sensor 31 detects a position of the watercraft 100. The position sensor 31 is, for example, a GNSS (Global Navigation Satellite System) receiver such as a GPS (Global Positioning System) receiver. However, the position sensor 31 may be a type of sensor other than the GNSS receiver. The position sensor 31 outputs a signal indicating the position of the watercraft 100. The watercraft operating controller 30 is connected to the position sensor 31 in a communicable manner. The watercraft operating controller 30 obtains the position of the watercraft 100 based on the signal received from the position sensor 31. Additionally, the watercraft operating controller 30 obtains a velocity of the watercraft 100 based on the signal received from the position sensor 31. The watercraft operating system may include another type of sensor to detect the velocity of the watercraft 100.

The watercraft operating system includes a cardinal direction sensor 32. The cardinal direction sensor 32 detects a course of the watercraft 100. The cardinal direction sensor 32 is, for instance, an IMU (Inertial Measurement Unit). However, the cardinal direction sensor 32 may be a type of sensor other than the IMU. The watercraft operating controller 30 is connected to the cardinal direction sensor 32 in a communicable manner. The watercraft operating controller 30 obtains the course of the watercraft 100 based on a signal received from the cardinal direction sensor 32.

The output device 29 outputs an alarm notification in accordance with the command signal received from the watercraft operating controller 30. For example, the output device 29 includes a speaker and outputs an alarm sound therefrom. Alternatively, the output device 29 may include a display and may display an alarm image thereon. Yet alternatively, the output device 29 may include an alarm lamp and may light up the alarm lamp.

The first input device 27 is operable by the operator to select one of the control modes of each marine propulsion device 1*a*, 1*b*. The first input device 27 may be disposed on a watercraft operating device such as a joystick. Alternatively, the first input device 27 may be disposed in a position separated from the watercraft operating device. The first input device 27 includes a mode switch 27*a*. The first input device 27 may not necessarily include the mode switch 27*a*, and alternatively, may include another type of device such as a touchscreen. The first input device 27 outputs a command signal indicating the control mode selected by the operator. The watercraft operating controller 30 receives the command signal from the first input device 27. The watercraft operating controller 30 executes an automated watercraft control for the watercraft 100 in accordance with the selected control mode. The watercraft operating controller 30 controls the marine propulsion devices 1*a* and 1*b* in the automated watercraft control such that the watercraft 100 moves in accordance with the selected control mode.

In the automated watercraft control, the watercraft operating controller 30 causes each marine propulsion device 1*a*, 1*b* to generate a thrust oriented in the forward moving direction by controlling each drive unit 2*a*, 2*b* and each shift actuator 7*a*, 7*b*. The watercraft 100 thus moves forward. In the automated watercraft control, the watercraft operating controller 30 changes the rudder angle of each marine propulsion device 1*a*, 1*b* by controlling each steering actuator 8*a*, 8*b*. The watercraft 100 thus turns right and left.

Figure 4:
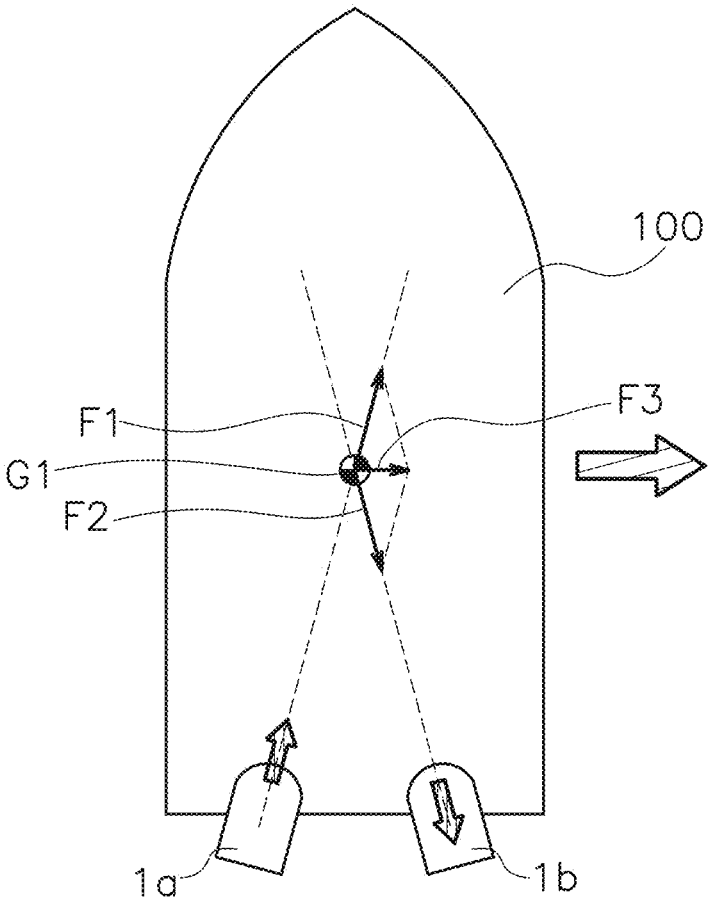
FIG. 4 is a schematic diagram showing controls of the marine propulsion devices.

As shown in FIG. 4, in the automated watercraft control, the watercraft operating controller 30 controls the thrust and the rudder angle of each marine propulsion device 1*a*, 1*b* such that a net thrust (F3) of the thrust (F1) of the marine propulsion device 1*a* and the thrust (F2) of the marine propulsion device 1*b* is oriented sideways from the center of gravity (G1) of the watercraft 100. The watercraft 100 thus performs a translational motion in a sideways direction. In the automated watercraft control, the watercraft operating controller 30 controls the thrust and the rudder angle of each marine propulsion device 1*a*, 1*b* such that the net thrust F3 extends from a position displaced from the center-of-gravity G1 of the watercraft 100. The watercraft 100 thus performs a bow turning motion. Alternatively, in the automated watercraft control, the watercraft operating controller 30 may cause the watercraft 100 to perform the bow turning motion by causing one of the marine propulsion devices 1*a* and 1*b* to generate a thrust oriented in the forward moving direction and causing the other to generate a thrust oriented in the rearward moving direction. Yet alternatively, in the automated watercraft control, the watercraft operating controller 30 may cause the watercraft 100 to perform the bow turning motion by causing the marine propulsion devices 1*a* and 1*b* to turn right and left. The watercraft operating controller 30 may change how the bow turning motion is performed depending on the level of thrust of each marine propulsion device 1*a*, 1*b* set by the operator.

The second input device 28 is operable by the operator to perform a control mode setting. The second input device 28 is, for instance, a touchscreen. The second input device 28 is not limited to the touchscreen, and alternatively, may include another type of device such as at least one switch. The second input device 28 outputs a command signal indicating the setting of the control mode selected by the operator. The watercraft operating controller 30 receives the command signal from the second input device 28.

Figure 5:
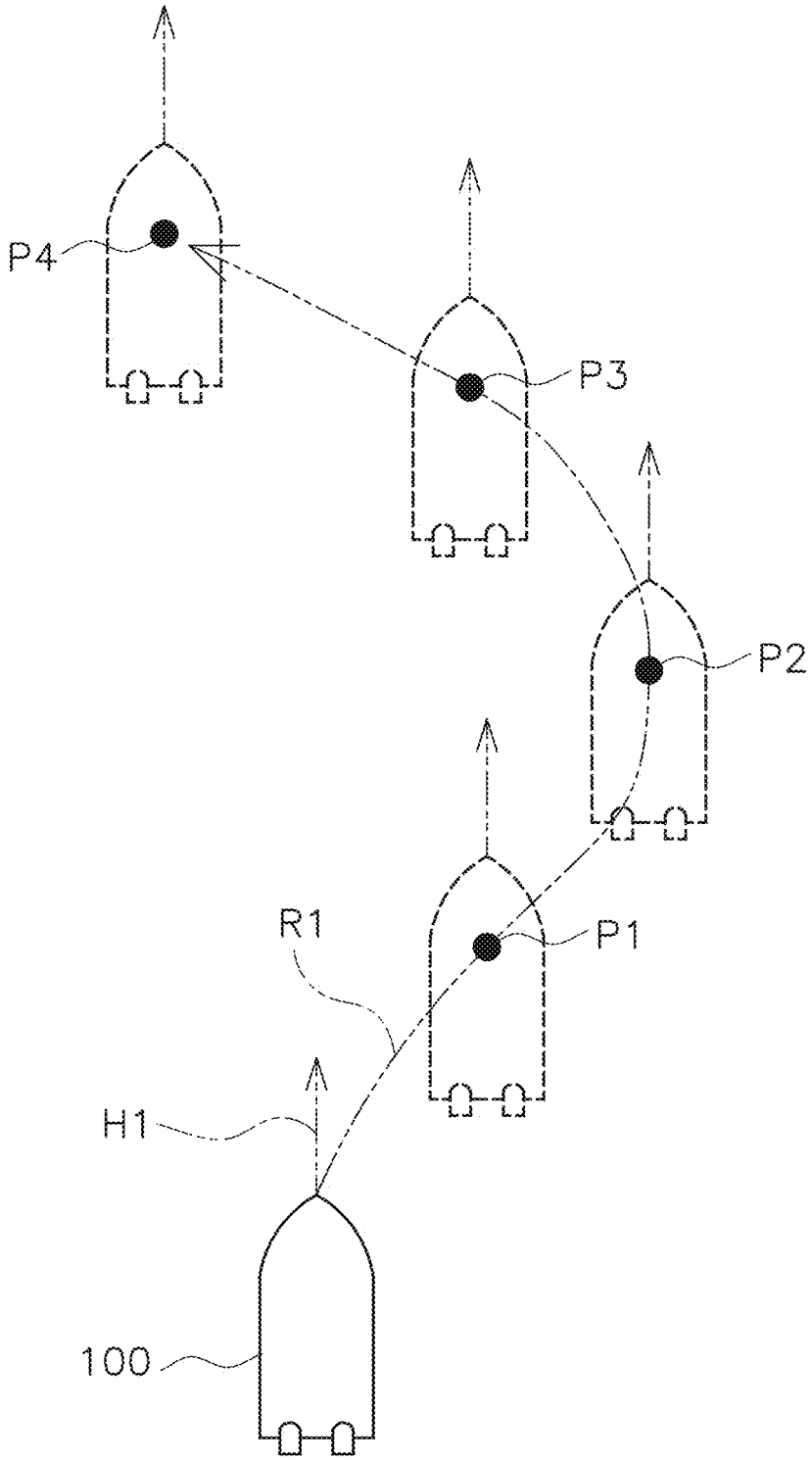
FIG. 5 is a diagram showing a series of motions performed by the watercraft in a first mode.

The control modes include a first mode and a second mode. As shown in FIG. 5, in the first mode, the watercraft operating controller 30 controls the marine propulsion devices 1*a* and 1*b* such that the watercraft 100 moves along a set route R1 with the bow thereof being kept oriented in a target cardinal direction H1. For example, the watercraft operating controller 30 sets, as the target cardinal direction H1, a cardinal direction in which the watercraft 100 is oriented when the first mode is selected. Alternatively, the operator may arbitrarily set the target cardinal direction H1 with the first input device 27. Even when the watercraft 100 drifts due to the influence of the wind or tide, the watercraft operating controller 30 controls the marine propulsion devices 1*a* and 1*b* such that the watercraft 100 is kept oriented in the target cardinal direction H1.

The operator sets the route R1 with the second input device 28. More specifically, the operator specifies a plurality of spots P1 to P4, including the spot P4 as a destination, with the second input device 28. For example, the operator arbitrarily selects the spots P1 to P4 on a map displayed on the second input device 28. The watercraft operating controller 30 computes the route R1 on which the spots P1 to P4 are located. The watercraft operating controller 30 controls the marine propulsion devices 1*a* and 1*b* such that the watercraft 100 moves along the route R1.

Figure 6:
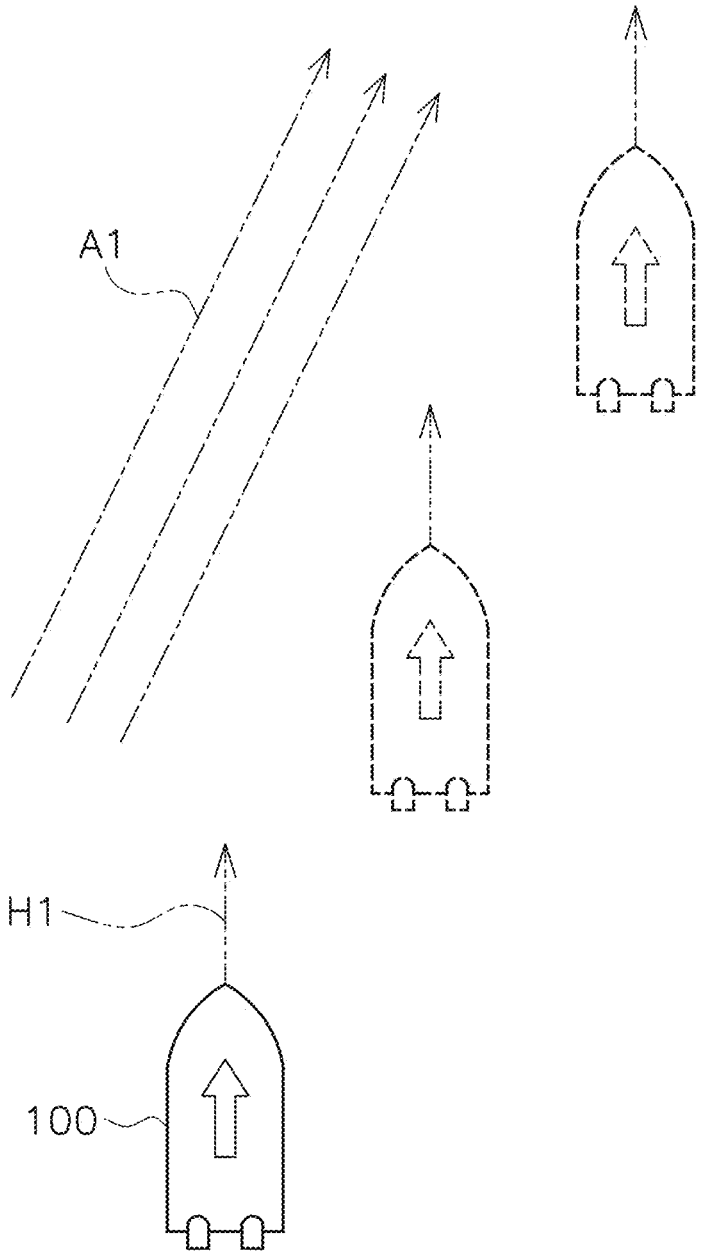
FIG. 6 is a diagram showing a series of motions performed by the watercraft in a second mode.

In the second mode, the watercraft operating controller 30 keeps the bow of the watercraft 100 oriented in the target cardinal direction H1 without determining any route. As shown in FIG. 6, in the second mode, the watercraft operating controller 30 controls the marine propulsion devices 1*a* and 1*b* such that the watercraft 100 is kept oriented in the target cardinal direction H1. For example, the watercraft operating controller 30 sets, as the target cardinal direction H1, a cardinal direction in which the watercraft 100 is oriented when the second mode is selected. Alternatively, the operator may arbitrarily set a target cardinal direction H2 with the first input device 27. In the second mode, the watercraft operating controller 30 does not determine any route. Therefore, in the second mode, the watercraft 100 is able to drifted with the wind or tide A1.

Figure 7:
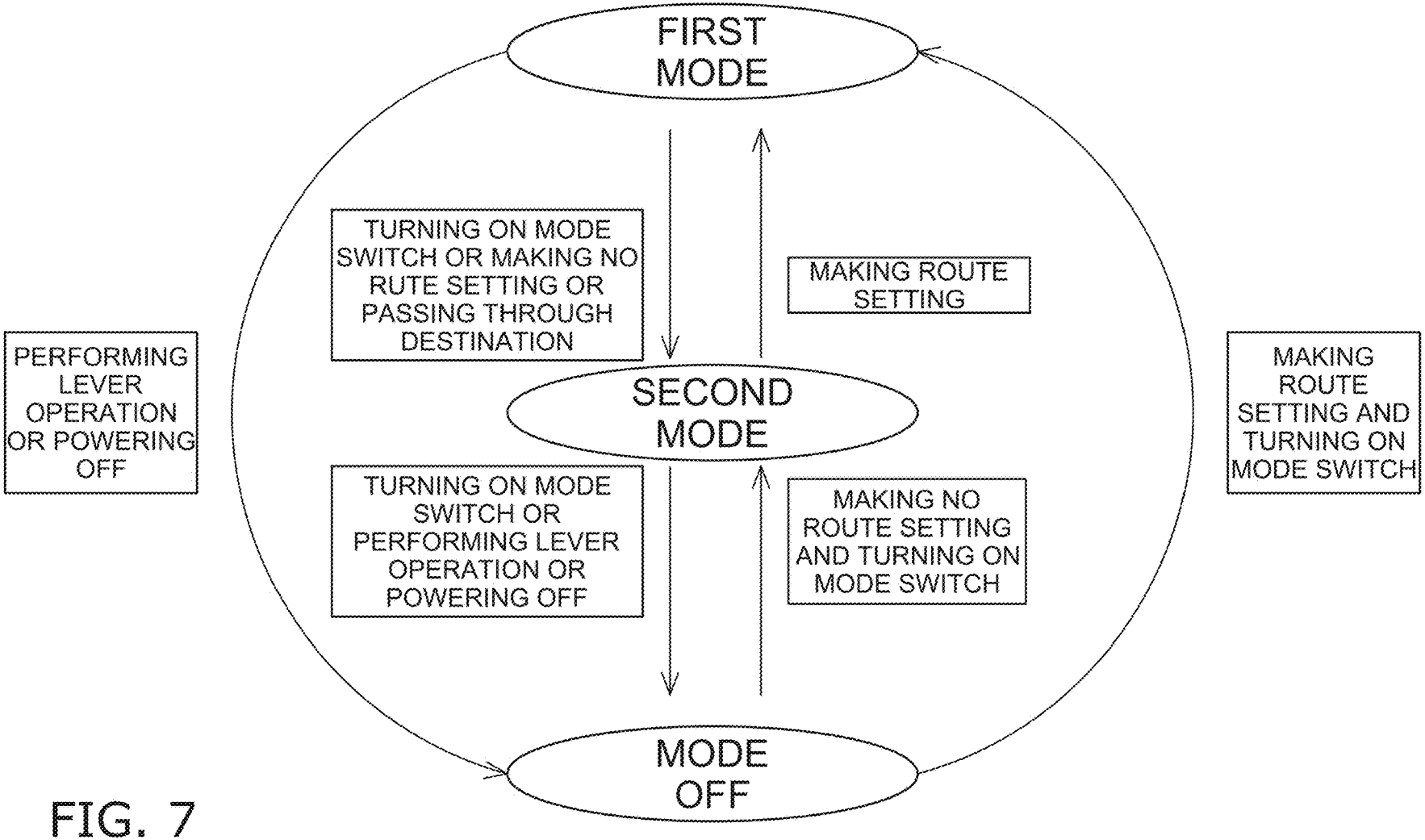
FIG. 7 is a diagram showing conditions for transition among the modes.

FIG. 7 is a diagram showing conditions for transition between the first mode and the second mode. In FIG. 7, "mode off" means a state that the first and second modes are neither selected, and all the control modes are disabled. When one or more predetermined conditions for transition are satisfied, the watercraft operating controller 30 performs control mode switching among the mode-off state, the first mode, and the second mode.

As shown in FIG. 7, the watercraft operating controller 30 enables the first mode when both route setting and operating the mode switch 27*a* are performed in the off mode. When the first or second throttle lever 25*a*, 25*b* is operated in the first mode, the watercraft operating controller 30 ends the first mode and turns off the control modes. When the watercraft operating system is powered off in the first mode, the watercraft operating controller 30 turns off the control modes. When the steering wheel 24 or any other operating device such as a joystick is operated in the first mode, the watercraft operating controller 30 may turn off the control modes.

When the mode switch 27*a* is operated without any route setting in the mode-off state, the watercraft operating controller 30 enables the second mode. When the mode switch 27*a* is operated in the second mode, the watercraft operating controller 30 ends the second mode and turns off the control modes. When the first or second throttle lever 25*a*, 25*b* is operated in the second mode, the watercraft operating controller 30 ends the second mode and turns off the control modes. When the watercraft operating system is powered off in the second mode, the watercraft operating controller 30 turns off the control modes.

When route setting is made in the second mode, the watercraft operating controller 30 performs control mode switching from the second mode to the first mode. When the mode switch 27*a* is operated in the first mode, the watercraft operating controller 30 performs control mode switching from the first mode to the second mode. When route setting is canceled in the first mode, the watercraft operating controller 30 performs control mode switching from the first mode to the second mode.

Additionally, when the watercraft 100 arrives at the destination in the first mode, the watercraft operating controller 30 performs control mode switching from the first mode to the second mode. The watercraft operating controller 30 herein determines whether or not the watercraft 100 has passed through the destination in the first mode. The watercraft operating controller 30 obtains the position of the watercraft 100 based on the signal received from the position sensor 31. When one or more predetermined conditions are satisfied, the watercraft operating controller 30 determines that the watercraft 100 has passed through the destination.

The one or more predetermined conditions include a first condition, a second condition, and a third condition. The first condition is that the watercraft 100 is moving in a predetermined direction along a set route. The second condition is that a predetermined time has elapsed after arrival of the watercraft 100 at a destination. The third condition is that the watercraft 100 has moved away from the destination by a predetermined distance after arrival at the destination. When the first to third conditions are all satisfied, the watercraft operating controller 30 determines that the watercraft 100 has passed through the destination.

It should be noted that in control mode switching from the first mode to the second mode, the watercraft operating controller 30 controls the output device 29 to output an alarm. The watercraft operating controller 30 may control the output device 29 to output an alarm in control mode switching among the first mode, the second mode, and the mode-off state.

Figure 8:
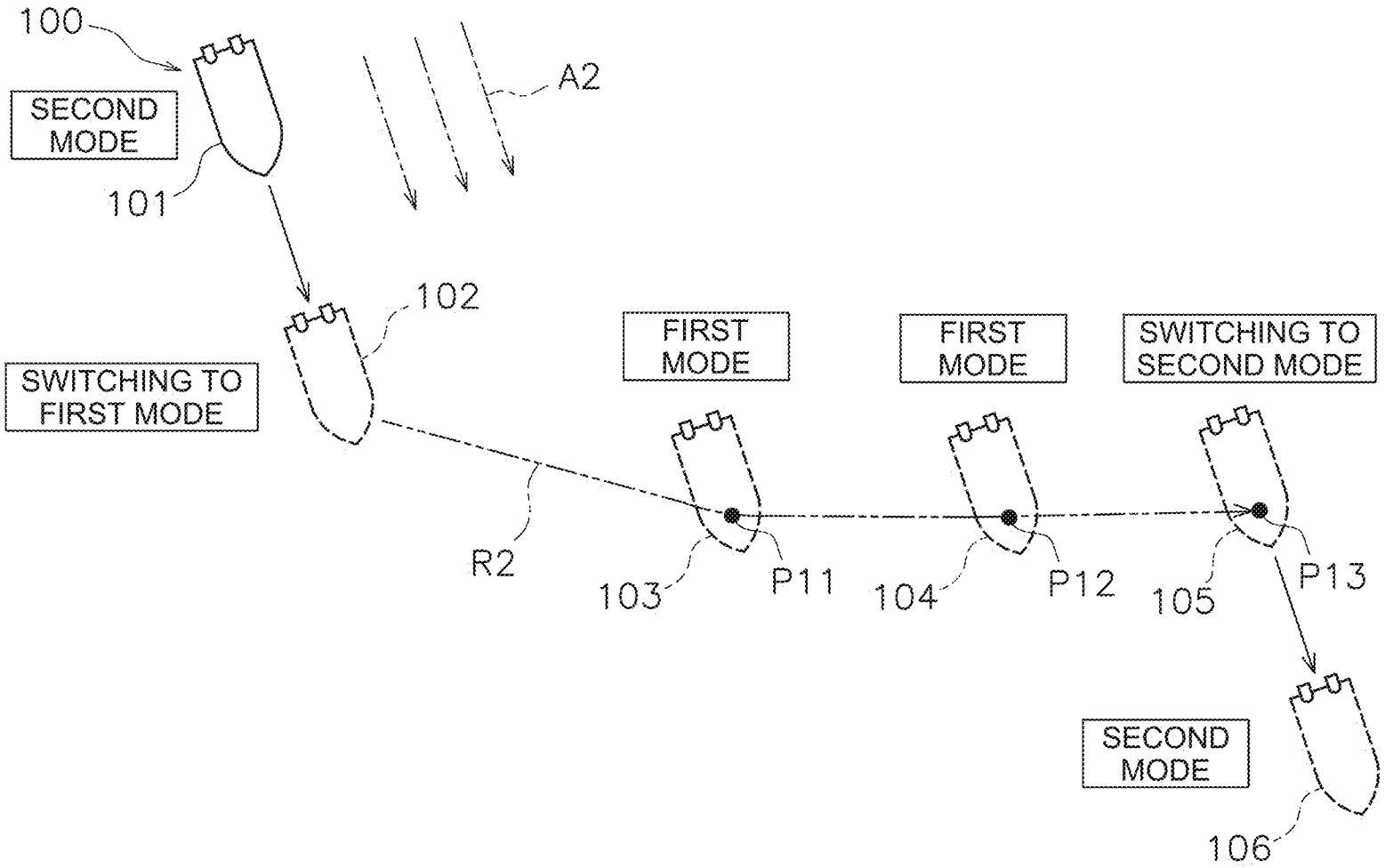
FIG. 8 is a diagram showing a series of motions performed by the watercraft in transition among the modes.

FIG. 8 is a diagram showing a series of motions performed by the watercraft 100 in control mode transition. As shown in FIG. 8, the watercraft 100 is controlled in the second mode at a position 101. Because of this, the watercraft 100 moves with a water stream A2 to a position 102, with the bow thereof being kept oriented in a predetermined direction. At the position 102, the operator inputs spots P11 and P12 and a destination P13 into the second input device 28, such that a route R2 is set. Additionally, the operator operates the mode switch 27*a* such that the watercraft operating controller 30 performs control mode switching from the second mode to the first mode. Accordingly, the watercraft 100 moves along the route R2 with the bow thereof being kept oriented in the predetermined direction.

The watercraft 100 passes through positions 103 and 104 in the first mode and arrives at the destination P13 at a position 105. When the watercraft 100 passes through the destination P13, the watercraft operating controller 30 performs control mode switching from the first mode to the second mode. Accordingly, the watercraft 100 moves with the water stream A2 to a position 106, with the bow thereof being kept oriented in the predetermined direction.

In the watercraft operating system according to the preferred embodiments explained above, when the first mode is being selected, the route R2, on which the specified spots P11 to P13 including the spot P13 as the destination P13 are located, is set and the marine propulsion devices 1*a* and 1*b* are controlled such that the watercraft 100 moves along the route R2 with the bow thereof being kept oriented in the predetermined cardinal direction. Accordingly, the watercraft 100 automatically moves to the destination P13. When the watercraft 100 passes through the destination in the first mode, control mode switching is automatically made from the first mode to the second mode without operating the mode switch 27*a* by the operator. In the second mode, the marine propulsion devices 1*a* and 1*b* are controlled such that the bow of the watercraft 100 is kept oriented in the predetermined cardinal direction without determining the route R2. Accordingly, the watercraft 100 is able to move with the water stream A2 with the bow thereof being kept oriented in the predetermined direction. Because of this, even after the watercraft 100 has automatically moved to the destination P13, a user is able to continue fishing comfortably.

Preferred embodiments of the present invention have been explained above. However, the present invention is not limited to the preferred embodiments described above, and a variety of changes can be made without departing from the gist of the present invention.

Each marine propulsion device is not limited to the outboard motor, and alternatively, may be another type of propulsion device such as an inboard engine outboard drive or a jet propulsion device. The structure of each marine propulsion device is not limited to that in the preferred embodiments described above and may be changed. For example, the first drive unit 2*a* is not limited to the internal combustion engine, and alternatively, may be an electric motor. Yet alternatively, the first drive unit 2*a* may be a hybrid system of an internal combustion engine and an electric motor. The number of marine propulsion devices is not limited to two. The number of marine propulsion devices may be more than two.

The conditions for transition among the control modes are not limited to those in the preferred embodiments described above and may be changed. For example, the conditions for transition in the preferred embodiments described above may be omitted or changed in part. One or more conditions, different from the conditions for transition in the preferred embodiments described above, may be added thereto. The conditions for determining that the watercraft 100 has passed through a destination are not limited to those in the preferred embodiments described above and may be changed.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A system for controlling a watercraft, the system comprising:

a marine propulsion device;

a position sensor to detect a position of the watercraft;

an input that is manually operable and able to output an operating signal indicating a selected one of a plurality of modes including a first mode and a second mode; and a controller configured or programmed to:

receive the operating signal;

when the selected one of the plurality of modes is the first mode, determine a route on which a single or a plurality of specified spots including a destination are located, and control the marine propulsion device such that the watercraft moves along the route with a bow of the watercraft being kept oriented in a predetermined cardinal direction;

when the selected one of the plurality of modes is the second mode, control the marine propulsion device such that the bow of the watercraft is kept oriented in the predetermined cardinal direction without determining the route;

obtain the position of the watercraft;

determine whether or not the watercraft has passed through the destination in the first mode; and when the watercraft has passed through the destination in the first mode, perform mode switching from the first mode to the second mode and control the marine propulsion device in the second mode.

2. The system according to claim 1, further comprising:

an output to output an alarm; wherein the controller is further configured or programmed to control the output to output the alarm when performing the mode switching from the first mode to the second mode.

3. The system according to claim 1, wherein the controller is further configured or programmed to determine that the watercraft has passed through the destination when a predetermined time has elapsed after arrival of the watercraft at the destination.

4. The system according to claim 1, wherein the controller is further configured or programmed to determine that the watercraft has passed through the destination when the watercraft has moved away from the destination by a predetermined distance after arriving at the destination.

5. A method of controlling a watercraft including a marine propulsion device, the method comprising:

receiving an operating signal indicating a selected one of a plurality of modes including a first mode and a second mode;

when the selected one of the plurality of modes is the first mode, determining a route on which a single or a plurality of specified spots including a destination are located and controlling the marine propulsion device such that the watercraft moves along the route with a bow of the watercraft being kept oriented in a predetermined cardinal direction;

when the selected one of the plurality of modes is the second mode, controlling the marine propulsion device such that the bow of the watercraft is kept oriented in the predetermined cardinal direction without determining the route;

obtaining a position of the watercraft;

determining whether or not the watercraft has passed through the destination in the first mode; and when the watercraft has passed through the destination in the first mode, performing mode switching from the first mode to the second mode and controlling the marine propulsion device in the second mode.

6. The method according to claim 5, further comprising: when the mode switching is performed from the first mode to the second mode, controlling an output to output an alarm.

7. The method according to claim 5, further comprising: when a predetermined time has elapsed after arrival of the watercraft at the destination, determining that the watercraft has passed through the destination.

8. The method according to claim 5, further comprising: when the watercraft has moved away from the destination by a predetermined distance after arriving at the destination, determining that the watercraft has passed through the destination.

* * * * *